US009134031B2

(12) United States Patent
Nadkarni

(10) Patent No.: US 9,134,031 B2
(45) Date of Patent: Sep. 15, 2015

(54) COMBUSTOR OF A TURBOMACHINE INCLUDING MULTIPLE TUBULAR RADIAL PATHWAYS ARRANGED AT MULTIPLE CIRCUMFERENTIAL AND AXIAL LOCATIONS

(75) Inventor: Vaibhav Nadkarni, Karnataka (IN)

(73) Assignee: General Electric Company, Schenectady, NY (US)

( * ) Notice: Subject to any disclaimer, the term of this patent is extended or adjusted under 35 U.S.C. 154(b) by 882 days.

(21) Appl. No.: 13/343,510

(22) Filed: Jan. 4, 2012

(65) Prior Publication Data

US 2013/0167540 A1 Jul. 4, 2013

(51) Int. Cl.

| | |
|---|---|
| ***F23R 3/28*** | (2006.01) |
| ***F23R 3/32*** | (2006.01) |
| ***F23R 3/34*** | (2006.01) |
| ***F23R 3/36*** | (2006.01) |
| *F23R 3/54* | (2006.01) |

(52) U.S. Cl.

CPC . *F23R 3/32* (2013.01); *F23R 3/286* (2013.01); *F23R 3/346* (2013.01); *F23R 3/36* (2013.01); *F23R 3/54* (2013.01)

(58) Field of Classification Search

CPC ..... F23R 3/286; F23R 3/36; F23R 3/346; F23R 3/32; F23R 3/54; F23R 3/20

USPC ..... 60/737, 740, 748

See application file for complete search history.

(56) References Cited

U.S. PATENT DOCUMENTS

| | | | | |
|---|---|---|---|---|
| 1,777,411 | A | 10/1930 | Mayr | |
| 4,073,137 | A | 2/1978 | Roberts | |
| 5,699,667 | A | 12/1997 | Joos | |
| 5,761,906 | A | 6/1998 | Norster | |
| 6,109,038 | A | 8/2000 | Sharifi et al. | |
| 7,028,483 | B2 | 4/2006 | Mansour et al. | |
| 7,047,746 | B2 | 5/2006 | Hellat | |
| 7,185,494 | B2 | 3/2007 | Ziminsky et al. | |
| 7,426,833 | B2 | 9/2008 | Yoshida et al. | |
| 7,610,759 | B2 * | 11/2009 | Yoshida et al. | 60/737 |
| 7,673,455 | B2 | 3/2010 | Yoshida et al. | |
| 7,707,833 | B1 | 5/2010 | Bland et al. | |
| 7,921,650 | B2 | 4/2011 | Oda et al. | |
| 8,001,786 | B2 | 8/2011 | Oda et al. | |
| 8,015,814 | B2 | 9/2011 | Callas et al. | |
| 2012/0047897 | A1 * | 3/2012 | Hirata et al. | 60/737 |
| 2012/0291446 | A1 * | 11/2012 | Hirata et al. | 60/772 |
| 2012/0304649 | A1 * | 12/2012 | Matsuyama et al. | 60/737 |
| 2014/0083102 | A1 * | 3/2014 | Miura et al. | 60/737 |
| 2014/0238025 | A1 * | 8/2014 | Uhm et al. | 60/737 |

FOREIGN PATENT DOCUMENTS

| | | | |
|---|---|---|---|
| JP | 7012314 | A | 1/1995 |
| JP | 8261466 | A | 10/1996 |

* cited by examiner

*Primary Examiner* — William H Rodriguez

(57) ABSTRACT

A combustor of a turbomachine is provided and includes an assembly defining an interior and being configured to direct air to flow along an annulus in a first direction about the interior and in a second direction toward the interior, the first and second directions being substantially opposed, a manifold configured to be supplied with fuel and a tubular body defining a pathway along which the air is transmittable in a third direction from the annulus to the interior, the third direction being transverse to the first and second directions. The tubular body includes a sidewall extendible through the manifold. The sidewall defines an injection hole within the manifold by which transmitted air is mixable with the fuel.

20 Claims, 1 Drawing Sheet

COMBUSTOR OF A TURBOMACHINE INCLUDING MULTIPLE TUBULAR RADIAL PATHWAYS ARRANGED AT MULTIPLE CIRCUMFERENTIAL AND AXIAL LOCATIONS

BACKGROUND OF THE INVENTION

The subject matter disclosed herein relates to a combustor of a turbomachine and, more particularly, to a combustor of a turbomachine including a tubular body defining a radial pathway.

A turbomachine generally includes a compressor, a combustor and a turbine. The compressor is configured to compress inlet air and to produce compressed air as an output. The combustor is receptive of the compressed air and combusts the compressed air along with fuel to produce a flow of high temperature fluids. The turbine is receptive of the high temperature fluids for power and/or electricity generation. At the head end of the combustor, the compressed air is normally transmitted into an interior of the combustor via micro-mixer tubes that are stacked axially in bundles around a center nozzle.

A problem in current designs is the maldistribution of air to the micro-mixer tubes. Incoming air is typically directed to follow a 180° turn before entering the micro-mixer tubes thus creating radial non-uniformity and the maldistribution.

BRIEF DESCRIPTION OF THE INVENTION

According to one aspect of the invention, a combustor of a turbomachine is provided and includes an assembly defining an interior and being configured to direct air to flow along an annulus in a first direction about the interior and in a second direction toward the interior, the first and second directions being substantially opposed, a manifold configured to be supplied with fuel and a tubular body defining a pathway along which the air is transmittable in a third direction from the annulus to the interior, the third direction being transverse to the first and second directions. The tubular body includes a sidewall extendible through the manifold. The sidewall defines an injection hole within the manifold by which transmitted air is mixable with the fuel.

According to another aspect of the invention, a combustor of a turbomachine is provided and includes a center body defining an interior, a first vessel disposed about the center body and including a manifold configured to be supplied with a first fluid, a second vessel disposed about the first vessel to define an annulus for a flow of a second fluid and a tubular body defining a radial pathway along which the second fluid is transmittable from the annulus to the interior of the center body. The tubular body includes a sidewall, which is extendible through the manifold. The sidewall defines an injection hole within the manifold by which the first fluid is mixable with transmitted second fluid.

According to yet another aspect of the invention, a combustor of a turbomachine is provided and includes an end cover, a center body disposed proximate to the end cover and defining an interior, a first vessel disposed about the center body and including a manifold configured to be supplied with a first fluid, a second vessel coupled to the end cover and disposed about the first vessel to define an annulus for a flow of a second fluid toward the end cover and the center body in sequence and a tubular body defining a radial pathway along which the second fluid is transmittable from the annulus to the interior of the center body. The tubular body includes a sidewall, which is extendible through the manifold. The sidewall defines an injection hole within the manifold by which the first fluid is mixable with transmitted second fluid.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

A turbomachine 10 may be provided, for example, as a gas turbine engine. The turbomachine 10 generally includes a compressor, a combustor 11 and a turbine. The compressor is configured to compress inlet air and to produce compressed air as an output. The combustor 11 is receptive of the compressed air and is formed to define first and second interiors. The compressed air is mixed with fuel within the first interior to form a mixture and the mixture is combusted within the second interior to produce a flow of high temperature fluids. The turbine is receptive of the high temperature fluids for power and/or electricity generation.

Figure 1:
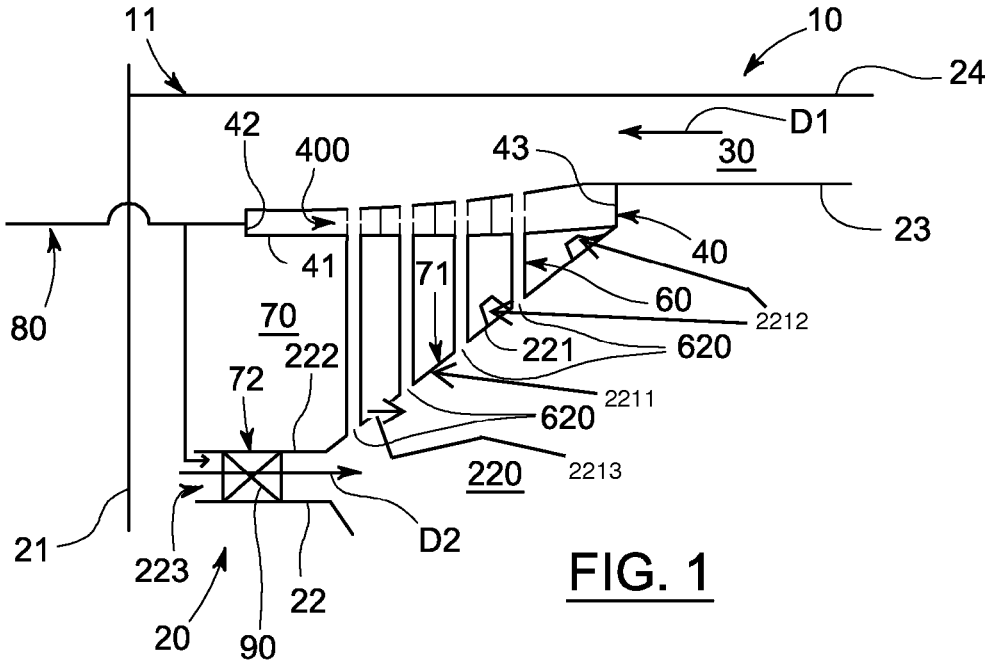
FIG. 1 is a side schematic view of a combustor of a turbomachine.
Figure 2:
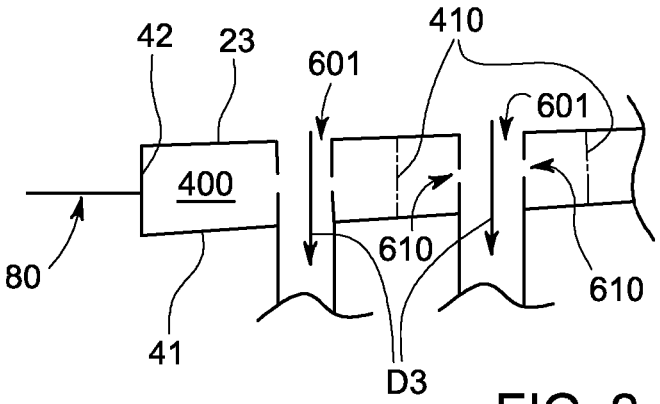
FIG. 2 is an enlarged side schematic view of a portion of the combustor of FIG. 1.

With reference to FIGS. 1 and 2, a head end of the combustor 11 of the turbomachine 10 includes a head end assembly 20, a manifold 40 and a tubular body 60. The head end assembly 20 includes an end cover 21, which is generally planar, a center body 22, which is disposed proximate to the end cover 21 and which is formed to define an interior 220, a first vessel 23 and a second vessel 24. The first vessel 23 is disposed about the center body 22 and includes the manifold 40, which is configured to be supplied with a first fluid, such as fuel. The second vessel 24 is coupled to and extends aft from the end cover 21 and is disposed about the first vessel 23. The second vessel 24 thereby defines an annulus 30 for a flow of a second fluid, such as air or compressed air from the compressor, toward the end cover 21 and the center body 22 in sequence. For purposes of clarity and brevity, the first fluid will now be referred to as fuel and the second fluid will now be referred to as compressed air although it is to be understood that this formulation is merely exemplary.

The head end assembly 20 is therefore formed to define the interior 220 and is configured to direct the compressed air to flow along the annulus 30 in a first direction D1 at a region defined radially about the interior 220 until the flow of the compressed air impinges upon the end cover 21. At this point, the head end assembly 20 is configured to direct the compressed air to flow radially inwardly along a plane of the end cover 21 toward the center body 22 whereupon the compressed air is redirected. Thereafter, the compressed air flows through the center body 22 and away from the end cover 21 in a second direction D2 toward the interior 220.

In accordance with embodiments, the first direction D1 and the second direction D2 are substantially opposed to one another. Thus, the head end assembly 20 provides for a reverse flow field for the compressed air.

The center body 22 includes an aft portion 221 through which the tubular body 60 is extendible and a forward portion 222. The aft portion 221 is disposed within the head end assembly 20 and defines the interior 220 as having a shape whereby combustion occurring therein can be controlled and high temperature fluids produced by the combustion can be directed toward the turbine. In accordance with embodiments, the aft portion 221 may have a frusto-conical shape that defines the interior 220 as having a corresponding frusto-conical shape. The forward portion 222 is disposed at a forward end of the aft portion 221 and defines a central pathway 223 for the flow of the compressed air from the end cover 21 to the interior 220. In accordance with embodiments where the aft portion 221 is frusto-conical, the forward portion 222 may be disposed at a narrow end of the aft portion 221. In accordance with further embodiments, the forward portion 222 may be tubular in shape such that the central pathway 223 has a corresponding tubular shape.

As shown in FIG. 1, an interior facing surface of the first vessel 23 and/or the manifold 40 forms an annular region 70 with respective exterior facing surfaces 71 and 72 of the aft portion 221 and the forward portion 222 of the center body 22. The end cover 21 may be further configured to direct the compressed air from the annulus 30 toward the respective exterior facing surfaces 71 and 72. The compressed air may thereby serve as impingement coolant for the aft portion 221 and the forward portion 222 of the center body 22. In accordance with further embodiments, the aft portion 221 may further include thermal barrier coating (TBC) 2211, turbulators 2212 and/or additional cooling features. In addition, the aft portion 221 may be formed to define effusion cooling holes 2213 through which the compressed air may pass.

The second vessel 24 may be a flow sleeve of the combustor 11 and may be provided as a peripheral, annular wall. The first vessel 23 may be a liner of the combustor 11 and may be provided as an annular wall disposed within the second vessel 24. The manifold 40 may be disposed at a forward end of the first vessel 23 and may be provided as an additional annular wall 41, which is disposed within the first vessel 23, and forward and aft sidewalls 42 and 43 connecting the additional annular wall 41 to the first vessel 23. The manifold 40 may therefore be formed to define an annular interior 400. In addition, the turbomachine 10 may include a supply circuit 80. The supply circuit 80 is fluidly coupled to the manifold 40 and is configured to supply the fuel to the annular interior 400 of the manifold 40.

The manifold 40 may also include partitions 410. The partitions 410 allow for axial staging of the fuel with each stage being isolated from an adjacent stage by a partition 410 and fed by a corresponding branch of the supply circuit 80. Such fuel staging could be conducted to aid in at least turndown operations of the turbomachine 10, to provide for axial distribution of heat release and to handle dynamics mitigation.

A swirler 90 may be disposed within the forward portion 222. As such, the swirler 90 may be configured to provide a swirling effect to the compressed air flowing along the central pathway 223. In addition, the forward portion 222 may be coupled to the supply circuit 80 and, as such, the forward portion 222 may be receptive of an amount of the fuel. In this case, the fuel received by the forward portion 222 and the swirled compressed air can be mixed in the forward portion 222 and injected into the interior 220 as a mixture of fuel and compressed air for combustion.

The tubular body 60 is formed to define a radial pathway 601 along which the compressed air is transmittable in a third direction D3 from the annulus 30 to the interior 220. The third direction D3 extends along a radial dimension of the combustor 11 and is oriented transversely with respect to the first and second directions D1 and D2, which extend along an axial dimension of the combustor 11. The tubular body 60 includes a sidewall 61, which is extendible through the manifold 40. The sidewall 61 is formed to define an injection hole 610 that is radially located within the annular interior 400 of the manifold 40. Due to the injection hole 610, as compressed air is transmitted along the pathway 601, the compressed air entrains fuel to enter the tubular body 60 and to mix with the transmitted compressed air to produce a mixture that can be injected into the interior 220.

The tubular body 60 may be oriented along the radial dimension. In addition, the tubular body 60 may have axial and tangential orientation components. Where the orientation of the tubular body 60 has an axial component, the tubular body 60 may be angled forwardly or reversely such that injection of the mixture into the interior can be correspondingly angled forwardly or reversely. Similarly, where the orientation of the tubular body 60 has a tangential component, the tubular body 60 may be angled with respect to a centerline of the combustor 11 such that injection of the mixture into the interior 220 can have an angular component and/or a swirled effect.

Figure 3:
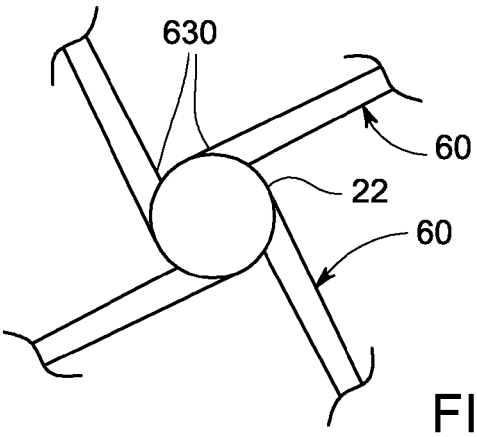
FIG. 3 is an enlarged axial schematic view of a portion of the combustor of FIG. 1.

As shown in FIGS. 1 and 2, the tubular body 60 may include a plurality of tubular bodies 60. The plurality of the tubular bodies 60 may be arranged at multiple axial stages 620. Further, with reference to FIG. 3, the plurality of the tubular bodies 60 may be arranged at multiple circumferential locations 630 at the one or more of the multiple axial stages 620.

As described above, the compressed air will be drawn into the tubular body(ies) 60 from the annulus 30 prior to reaching the end cover 21. Since, the flow of the compressed air in the annulus 30 is generally, substantially uniform, each tubular body(ies) 60 may receive a substantially equal amount of the compressed air (in accordance with embodiments, tubular bodies 60 at various axial stages 620 may receive varied quantities of the compressed air because of their different respective lengths). Also, liquid fuel is normally injected through a central cartridge and is atomized by atomizing air from a skid before the liquid fuel burns in a diffusion mode of the turbomachine 10. In accordance with embodiments, during liquid fuel operation of the turbomachine 10, outer gas manifolds may be purged and jets of only the compressed air may be injected from the tubular body(ies) 60 to the interior 220. Thus, the tubular body(ies) 60 may be employed to premix the atomized liquid fuel before burning.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor of a turbomachine, comprising:

an assembly defining an interior and being configured to direct air to flow along an annulus in a first direction about the interior and in a second direction toward the interior, the first and second directions being substantially opposed;

a manifold configured to be supplied with fuel; and a tubular body defining a pathway along which the air is transmittable in a third direction from the annulus to the interior, the third direction being transverse to the first and second directions, the tubular body including a sidewall extendible through the manifold, the sidewall defining an injection hole within the manifold by which transmitted air is mixable with the fuel.

2. The combustor according to claim 1, wherein an orientation of the tubular body has an axial component.

3. The combustor according to claim 1, wherein an orientation of the tubular body has a tangential component.

4. The combustor according to claim 1, wherein the tubular body comprises plural tubular bodies.

5. The combustor according to claim 4, wherein the plural tubular bodies are arranged at multiple axial stages.

6. The combustor according to claim 4, wherein the plural tubular bodies are arranged at multiple circumferential locations at one or more of multiple axial stages.

7. A combustor of a turbomachine, comprising:

a center body defining an interior;

a first vessel disposed about the center body and including a manifold configured to be supplied with a first fluid;

a second vessel disposed about the first vessel to define an annulus for a flow of a second fluid in a first axial direction and a region in which the second fluid is redirected to flow toward the interior in a second axial direction opposite the first axial direction; and a tubular body defining a radial pathway along which the second fluid is transmittable from the annulus to the interior of the center body, the tubular body located axially downstream from the region and including a sidewall, which is extendible through the manifold, the sidewall defining an injection hole within the manifold by which the first fluid is mixable with transmitted second fluid.

8. The combustor according to claim 7, wherein the first fluid comprises fuel and the second fluid comprises air.

9. The combustor according to claim 7, further comprising a supply circuit fluidly coupled to the manifold for supplying the first fluid to the manifold.

10. The combustor according to claim 7, further comprising an end cover configured to direct the second fluid from the annulus to the center body.

11. A combustor of a turbomachine, comprising:

a center body defining an interior;

a first vessel disposed about the center body and including a manifold configured to be supplied with a first fluid;

a second vessel disposed about the first vessel to define an annulus for a flow of a second fluid;

a tubular body defining a radial pathway along which the second fluid is transmittable from the annulus to the interior of the center body, the tubular body including a sidewall, which is extendible through the manifold, the sidewall defining an injection hole within the manifold by which the first fluid is mixable with transmitted second fluid; and an end cover configured to direct the second fluid from the annulus to the center body, wherein the center body comprises:

an aft portion through which the tubular body is extendible; and a forward portion disposed at a forward end of the aft portion and defining a central pathway for a flow of the second fluid from the end cover to the interior of the center body.

12. The combustor according to claim 11, wherein the end cover is further configured to direct the second fluid from the annulus toward the aft portion.

13. The combustor according to claim 11, wherein the aft portion comprises one or more of thermal barrier coating (TBC) and turbulators.

14. The combustor according to claim 11, wherein the aft portion is formed to define effusion holes.

15. The combustor according to claim 11, further comprising a swirler disposed within the forward portion, the forward portion being receptive of the first fluid.

16. The combustor according to claim 7, wherein an orientation of the tubular body has at least one of an axial component and a tangential component.

17. The combustor according to claim 7, wherein the tubular body comprises plural tubular bodies.

18. The combustor according to claim 17, wherein the plural tubular bodies are arranged at multiple axial stages.

19. The combustor according to claim 17, wherein the plural tubular bodies are arranged at multiple circumferential locations at one or more of multiple axial stages.

20. A combustor of a turbomachine, comprising:

an end cover;

a center body disposed proximate to the end cover and defining an interior;

a first vessel disposed about the center body and including a manifold configured to be supplied with a first fluid;

a second vessel coupled to the end cover and disposed about the first vessel to define an annulus for sequential flows of a second fluid toward the end cover in a first axial direction, along the end cover in a radial direction and toward the interior of the center body in a second axial direction opposite the first axial direction; and a tubular body defining a radial pathway along which the second fluid is transmittable from the annulus to the interior of the center body, the tubular body including a sidewall, which is extendible through the manifold, the sidewall defining an injection hole within the manifold by which the first fluid is mixable with transmitted second fluid, and the tubular body being located axially downstream from a region in which the second fluid flows in the radial direction and is directed to flow in the second axial direction.

* * * * *